US011027889B1

(12) United States Patent
Western et al.

(10) Patent No.: US 11,027,889 B1
(45) Date of Patent: Jun. 8, 2021

(54) FLEXIBLE MAGNETIC AND INTERLOCKING SEALING APPARATUS

(71) Applicant: Fidlock GmbH, Hannover (DE)

(72) Inventors: Donald Western, Oceanside, CA (US); William Lee, Taipei (TW)

(73) Assignee: Fidlock GmbH, Hannover (DE)

( * ) Notice: Subject to any disclaimer, the term of this patent is extended or adjusted under 35 U.S.C. 154(b) by 261 days.

(21) Appl. No.: 16/407,172

(22) Filed: May 8, 2019

Related U.S. Application Data

(60) Provisional application No. 62/668,714, filed on May 8, 2018.

(51) Int. Cl.
*H01F 7/02* (2006.01)
*B65D 33/16* (2006.01)
*E06B 7/16* (2006.01)

(52) U.S. Cl.
CPC ..... *B65D 33/1658* (2013.01); *E06B 7/16* (2013.01); *H01F 7/0263* (2013.01)

(58) Field of Classification Search
CPC ..... B65D 33/1658; H01F 7/0263
See application file for complete search history.

(56) References Cited

U.S. PATENT DOCUMENTS 2,319,292 A * 5/1943 Boggs ..... A41F 1/002 2/96
2,389,298 A * 11/1945 Ellis ..... A41F 1/002 335/303
3,161,932 A * 12/1964 Russell ..... A41F 1/002 24/303
3,727,658 A * 4/1973 Eldridge, Jr. ..... A61B 50/362 206/370
3,827,019 A * 7/1974 Serbu ..... A41F 1/002 335/285
3,998,004 A * 12/1976 Ehrlich ..... A63H 33/046 446/92
4,462,596 A * 7/1984 Yamamoto ..... A63F 3/00694 273/239
4,826,059 A * 5/1989 Bosch ..... A45C 11/24 206/350
5,545,157 A * 8/1996 Van Iten ..... A61F 13/5616 2/46
5,604,960 A * 2/1997 Good ..... A41F 1/002 24/303
5,682,653 A * 11/1997 Berglof ..... G09F 1/10 24/303
6,101,688 A * 8/2000 Marchesi ..... A41F 1/002 24/303
6,226,842 B1 * 5/2001 Wong ..... A41F 1/002 24/303
6,301,754 B1 * 10/2001 Grunberger ..... A41F 1/002 24/303
7,022,394 B2 * 4/2006 Fujisawa ..... A44B 18/0076 428/99

(Continued)

*Primary Examiner* — Jason W San
(74) *Attorney, Agent, or Firm* — The Webb Law Firm

(57) ABSTRACT

The present invention provides a sealing closure made of flexible magnetic strips with a non-uniform thickness, which provide an improved interlocked seal in addition to a magnetic seal. The sealing closure has strips with at least one guide that aligns automatically with another strip when the two strips are brought together to create a more secure sealing closure.

20 Claims, 4 Drawing Sheets

(56) References Cited

U.S. PATENT DOCUMENTS 7,154,363 B2 * 12/2006 Hunts ..... H01F 7/0242 335/306
8,100,735 B2 * 1/2012 Park ..... A63H 33/046 446/92
8,395,465 B2 * 3/2013 Lauder ..... H01F 7/04 335/219
8,695,193 B2 * 4/2014 Kress ..... A47H 99/00 29/414
8,915,208 B2 * 12/2014 Shanahan ..... G09F 21/04 116/173
9,549,580 B2 * 1/2017 Horton ..... A41D 3/02
9,721,712 B2 * 8/2017 Provencher ..... A41F 1/002
9,966,174 B2 * 5/2018 Naftali ..... A45C 13/1069
10,117,504 B2 * 11/2018 Bataillou ..... A44C 5/20
10,376,022 B2 * 8/2019 Duncan ..... A44C 5/2071
10,568,374 B2 * 2/2020 Klein-Kassab ..... A44B 19/267
10,629,349 B2 * 4/2020 Naftali ..... A45C 13/1069
2001/0014998 A1 * 8/2001 Grunberger ..... A41F 1/002 24/303
2003/0029006 A1 * 2/2003 Pelt ..... A45F 5/06 24/303
2006/0006969 A1 * 1/2006 Cassar ..... B23Q 3/1546 335/306
2006/0282993 A1 * 12/2006 Dietz ..... B43K 23/001 24/303
2009/0178245 A1 * 7/2009 Albert ..... A41F 1/002 24/303
2009/0289090 A1 * 11/2009 Fullerton ..... A45F 5/02 224/183
2010/0275419 A1 * 11/2010 Millus ..... A47G 21/167 24/306
2011/0131742 A1 * 6/2011 Cheung ..... A47L 23/10 15/210.1
2012/0216374 A1 * 8/2012 Manuello ..... A41F 1/002 24/303
2014/0143985 A1 * 5/2014 Horton ..... A41B 1/10 24/303
2015/0196955 A1 * 7/2015 Naftalin ..... B29C 64/153 277/629
2016/0003269 A1 * 1/2016 Russell-Clarke .... A43B 1/0054 24/303
2017/0062109 A1 * 3/2017 Good ..... B65D 33/24

* cited by examiner

FLEXIBLE MAGNETIC AND INTERLOCKING SEALING APPARATUS

CROSS-REFERENCE TO RELATED APPLICATION

The present application claims priority to U.S. Provisional Patent Application No. 62/668,714, filed on May 8, 2018, entitled "FLEXIBLE MAGNETIC AND INTERLOCKING SEALING APPARATUS," and U.S. Provisional Patent Application No. 62/685,884, filed on Jun. 15, 2018, entitled "FLEXIBLE MAGNETIC AND INTERLOCKING SEALING APPARATUS," the entire disclosure of which are incorporated by reference herein.

BACKGROUND OF INVENTION

1. Field of Invention

The present invention relates to a watertight closure and more specifically, to a sealing closure which is flexible, interlocking, and stable to mechanical deformations.

2. Description of Related Art

U.S. Pat. No. 9,966,174 (referred hereafter as the Gooper patent), the entire disclosure of which is incorporated by reference herein, discloses a sealable closure comprising a flexible first strip, a flexible second strip, and a flexible third strip, wherein each strip has a predetermined uniform thickness and includes a plurality of magnetic elements. The first and second strips provide a first seal when the first and second strips are brought together and the magnetic elements of the strips thereof attract each other, and the first, second, and third strips provide a second seal when the magnetic elements of the strips thereof magnetically attract each other.

However, there are limitations with the flexible magnetic strips of the Gooper patent. For example, the strips have a predetermined uniform thickness, which provide for a sealing closure susceptible to separation when the strips are misaligned. The use of magnetic elements such as Neodymium improve sealing strength between flexible strips, however, the misalignment of the strips with uniform thicknesses minimize the sealing strength. Separation would inevitably permit unwanted entry of external materials and undesired water leakage. Therefore, there is a need to use non-uniform, magnetic strips with interlocking guides within the flexible magnetic strips for self-alignment of the strips, which contribute to a stronger sealing closure while maintaining easy closure opening.

SUMMARY OF THE INVENTION

The present invention overcomes these and other deficiencies of the prior art by providing a sealing closure made of flexible magnetic strips with a non-uniform thickness, which provide an improved interlocked seal in addition to a magnetic seal. The sealing closure has strips with at least one guide that aligns automatically with another strip when the two strips are brought together to create a more secure sealing closure. The present invention can be used in various applications including but not limited to aquatic environments under high pressure.

In one embodiment of the invention, a magnetic sealing closure, comprises: a first flexible strip, having a first side and a second side, with a plurality of cavities having a plurality of magnetic elements therein, the second side of the first flexible strip having a raised portion; a second flexible strip, having a first side and a second side, with a plurality of cavities having a plurality of magnetic elements therein; a third flexible strip, having first side and a second side, with a plurality of cavities having a plurality of magnetic elements therein, the second side of the third flexible strip having a recessed portion corresponding to the raised portion of the second side of the first flexible strip; a first membrane coupled to the first side of the first strip, such that the plurality of magnetic elements of the first strip are flush mounted and embedded within the plurality of cavities between the first strip and the first membrane, the first membrane further coupled to the first side of the third strip, such that the plurality of magnetic elements of the third strip are flush mounted and embedded within the plurality of cavities between the third strip and the first membrane; and a second membrane coupled to the first side of the second strip, such that the plurality of magnetic elements of the second strip are flush mounted and embedded within the plurality of cavities between the second strip and the second membrane; wherein the first and the second strips provide a first seal when the first and the second strips are brought together from the first sides of the first and the second strips and magnetic elements of the first and the second strips magnetically attract each other, wherein the first and the third strips provide a second seal when the first, the second, and the third strips are subsequently brought together from the second sides of the first and the third strips and magnetic elements of the first and the third strips magnetically attract each other.

In another embodiment of the magnetic sealing closure as defined above, each of the membranes have a predetermined static friction coefficient which substantially prevents movement of the membranes with respect to each other.

In another embodiment of the magnetic sealing closure as defined above, the membranes are walls of a sealable device.

In another embodiment of the magnetic sealing closure as defined above, the magnetic elements of the strips comprise a material selected from the group consisting of: Neodymium, Neodymium Iron Boron (NdFeB), Samarium-Cobalt, or Electromagnet.

In another embodiment of the magnetic sealing closure as defined above, the first seal is stable to mechanical deformations selected from the group consisting of: bending, rotation, twisting, and/or tilting.

In another embodiment of the magnetic sealing closure as defined above, the first seal is flexible and water impermeable.

In another embodiment of the magnetic sealing closure as defined above, the strips and the membranes are sealingly connected via mechanical connection means, and the mechanical connection means are selected from the group consisting of: RF welding, ultrasonic welding, heat welding, sewing, via a seal tape, or gluing.

In another embodiment of the magnetic sealing closure as defined above, the sealing closure is incorporated in a sealable device which is selected from the group consisting of: a pouch, a bag, a sack, a pocket, a device useful for sterile purposes, a door with a frame, a tent, a greenhouse, or a waterproof pocket.

In another embodiment of the magnetic sealing closure as defined above, the second flexible strip has a non-uniform thickness.

In another embodiment of the magnetic sealing closure as defined above, the plurality of cavities of the first strip, the second strip, and the third strip are selected from the group consisting of: niches, recesses, pits, openings, holes, full openings, or apertures.

In another embodiment of the magnetic sealing closure as defined above, the sealing closure is manufactured according to a method selected from the group consisting of: extrusion, coextrusion, or molding.

In another embodiment of the magnetic sealing closure as defined above, the membranes each have a predetermined thickness of between 0.05 mm and 0.6 mm.

In another embodiment of the magnetic sealing closure as defined above, the membranes each have a predetermined thickness of between 0.2 mm and 0.4 mm.

In another embodiment of the magnetic sealing closure as defined above, the plurality of cavities of the strips are equally spaced between each other at a distance of between 2 mm and 8 mm, such that each magnetic element within each cavity of the plurality of cavities has a diameter of between 4 mm and 10 mm, and a thickness of between 1 mm and 3 mm.

In another embodiment of the magnetic sealing closure as defined above, the first strip and the second strip have a width of between 10 mm and 20 mm, and the uniform predetermined thickness of the first strip and the second strip is between 1 mm and 3 mm.

In another embodiment of the magnetic sealing closure as defined above, the membranes and the strips comprise polymeric materials selected from the group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ketone)s (PEEK, PES/PEEK), polyethylene (PE), polyethylene glycol) (PEG), poly (ethylene terephthalate) (PET), polypropylene (PP), polytetrafluoroethylene (PTFE), styrene-acrylonitrile resin (SAN), poly (trimethylene terephthalate) (PTT), polyurethane (PU), polyvinyl butyral (PVB), polyvinylchloride (PVC), polyvinylidenedifluoride (PVDF), or polyvinyl pyrrolidone (PVP).

In another embodiment of the magnetic sealing closure as defined above, the predetermined static friction coefficient of the membranes is between 0.01 and 0.99.

In another embodiment of the magnetic sealing closure as defined above, the predetermined static friction coefficient of the membranes is between 0.1 and 0.6.

In another embodiment, a magnetic sealing closure, comprises: a first flexible strip, having a first side and a second side, with a plurality of cavities having a plurality of magnetic elements therein, the second side of the first flexible strip having a recessed portion; a second flexible strip, having a first side and a second side, with a plurality of cavities having a plurality of magnetic elements therein; a third flexible strip, having a first side and a second side, with a plurality of cavities having a plurality of magnetic elements therein, the second side of the third flexible strip having a raised portion corresponding to the recessed portion of the second side of the first flexible strip; a first membrane coupled to said first side of the first strip, such that the plurality of magnetic elements of the first strip are flush mounted and embedded within said plurality of cavities between the first strip and the first membrane, said first membrane further coupled to the first side of the third strip, such that the plurality of magnetic elements of the third strip are flush mounted and embedded within the plurality of cavities between the third strip and the first membrane; and a second membrane coupled to the first side of the second strip, such that the plurality of magnetic elements of the second strip are flush mounted and embedded within the plurality of cavities between the second strip and the second membrane; wherein the first and the second strips provide a first seal when the first and the second strips are brought together from the first sides of the first and the second strips and magnetic elements of the first and the second strips magnetically attract each other, wherein the first and the third strips provide a second seal when the first, the second, and the third strips are subsequently brought together from the second sides of the first and the third strips and magnetic elements of the first and the third strips magnetically attract each other.

In another embodiment, a magnetic sealing closure, comprises: a first flexible strip, having a non-uniform thickness with one or more recesses or protrusions, a first side and a second side, with a plurality of cavities having a plurality of magnetic elements therein; a second flexible strip, having a first side and a second side, with a plurality of cavities having a plurality of magnetic elements therein; a third flexible strip, having a non-uniform thickness with one or more recesses or protrusions, a first side and a second side, with a plurality of cavities having a plurality of magnetic elements therein, the one or more recesses or protrusions of the third flexible strip mating to the one or more recesses or protrusions of the first flexible strip; a first membrane coupled to the first side of the first strip, such that the plurality of magnetic elements of the first strip are flush mounted and embedded within the plurality of cavities between the first strip and the first membrane, the first membrane further coupled to the first side of the third strip, such that the plurality of magnetic elements of the third strip are flush mounted and embedded within the plurality of cavities between the third strip and the first membrane; and a second membrane coupled to the first side of the second strip, such that the plurality of magnetic elements of the second strip are flush mounted and embedded within the plurality of cavities between the second strip and the second membrane; wherein the first and the second strips provide a first seal when the first and the second strips are brought together from the first sides of the first and the second strips and magnetic elements of the first and the second strips magnetically attract each other, wherein the first and the third strips provide a second seal when the first, the second, and the third strips are subsequently brought together from the second sides of the first and the third strips and magnetic elements of the first and the third strips magnetically attract each other.

In an embodiment of the invention, a sealing closure comprises a first flexible strip, a second flexible strip, a third flexible strip, a first membrane and a second membrane. The first, second, and third flexible strips each include a main axial member, a first side, a second side, a plurality of recessed areas, and a plurality of magnetic elements located within the plurality of recessed areas. The first and third flexible strips having a non-uniformed predetermined thickness defined by said first side and said second side. The first membrane is coupled to the first side of the first strip and is also coupled to the first side of the third strip. The second membrane is couple to the first side of the second strip. The first and second strips provide a first seal when the first and second strips magnetically attract each other. The first and third strips provide a second seal when the first, second, and third strips are brought together and the magnetic elements of the first and third strips magnetically attract each other. The non-uniformity allows for the sealing closure to further secure the first and second seals.

The present invention provides a low-cost, sealable device with an improved interlocked seal resulting from flexible magnetic strips with non-uniform thickness.

The foregoing, and other features and advantages of the invention, will be apparent from the following, more particular description of the preferred embodiments of the invention, and the accompanying drawings.

BRIEF DESCRIPTION OF THE DRAWINGS

For a more complete understanding of the present invention, the objects and advantages thereof, reference is now made to the ensuing descriptions taken in connections with the accompanying drawings described as follows.

Figure 1A:
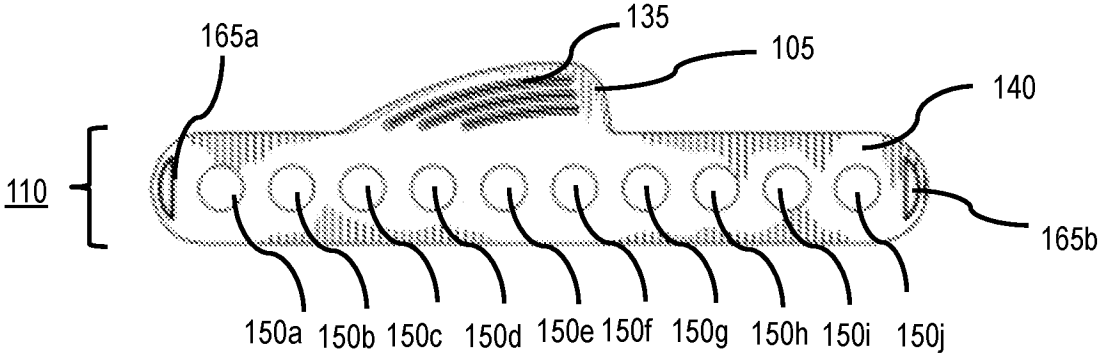
FIGS. 1A-1C illustrate specific embodiments of a sealing closure.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EMBODIMENTS

Further featured and advantages of the invention, as well as the structure and operation of various embodiments of the invention, are described in detail below with reference to the accompanying FIGS. 1-4.

The present invention provides a sealing closure that is flexible, magnetic, and interlocking, providing for an improved watertight magnetic seal.

Figure 1B:
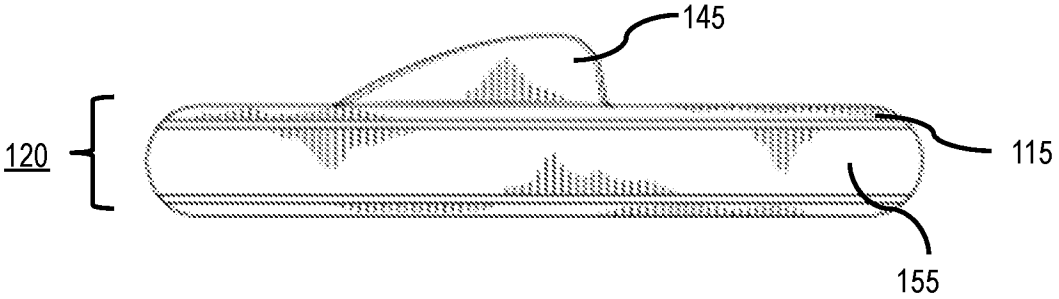
Figure 1C:
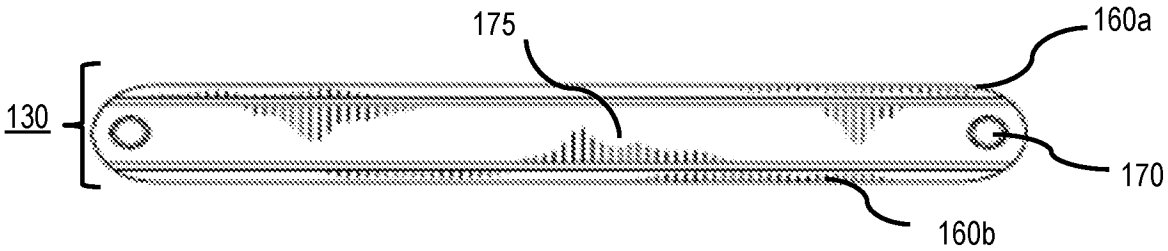

FIGS. 1A-1C illustrate a sealing closure according to an embodiment of the invention. Here, a first flexible strip 110, a second flexible strip 120, and a third flexible strip 130 are shown without a respective bag connected thereto. FIG. 1A illustrates the first flexible strip 110. The first flexible strip 110 comprises a first main axial member 140. The first main axial member 140 is flexible and can be made of plastic, rubber, polymer, silicone, elastomer, or similar materials, the identification of which is apparent to one of ordinary skill in the art. The first flexible strip 110 further comprises a plurality of recessed areas 150*a-j* each having a magnetic element disposed therein. Magnetic elements may consist of Neodymium, Neodymium Iron Boron (NdFeB), Samarium-Cobalt, Electromagnet or similar such elements. Although ten recessed areas are depicted, any number of recessed areas may be used without departing from the spirit or scope of the invention. The first flexible strip 110 is coupled to a first grip extension 105. The first grip extension 105 has at least one raised axial guide 135 (although three are shown as exemplary embodiment of the invention). The first flexible strip 110 has a first side (depicted in FIG. 1A) and a second backside (not shown). In an embodiment of the invention, the first flexible strip 110 has a non-uniform thickness defined by the first and second sides. For example, the second side has at least one raised axial guide. In another embodiment the first side has at least one raised axial guide.

FIG. 1B illustrates a second flexible strip 120. The second flexible strip 120 comprises a second main axial member. The second main axial member is flexible and can be made of plastic, rubber, polymer, silicone, elastomer, or similar materials. The second flexible strip 120 is affixed to a second grip extension 145. The second grip extension 145 has at least one raised axial guide 135 (not shown as it is present on the backside). The second flexible strip 120 further comprises a plurality of recessed areas having a plurality of magnetic elements (not shown). The second flexible strip 120 has a first side (depicted in FIG. 1B) and a second side (not shown). The second flexible strip 120 has a non-uniform thickness. For example, the first side has at least on raised protrusion 155 and at least one recessed edge 115. In another embodiment the second side has at least one raised protrusion.

FIG. 1C illustrates a third flexible strip 130. The third flexible strip 130 comprises a third main axial member. The third main axial member is flexible and can be made of plastic, rubber, polymer, silicone, elastomer, or similar materials. The third flexible strip 130 further comprises a plurality of recessed areas having a plurality of magnetic elements (not shown). The third flexible strip 130 has a first side (depicted in FIG. 1C) and a second side (not shown). The third flexible strip has a non-uniform thickness defined by the first and second sides. For example, the second side has at least one recessed axial guide. In another embodiment the first side has at least one recessed axial guide 160. Furthermore, the third flexible strip 130 may comprise holes 170 at each end for attachment to a lanyard. Ideally, the third flexible strip 130 is longer than the first and second flexible strips 110 and 120, so that the holes 170 may be exposed.

Figure 2:
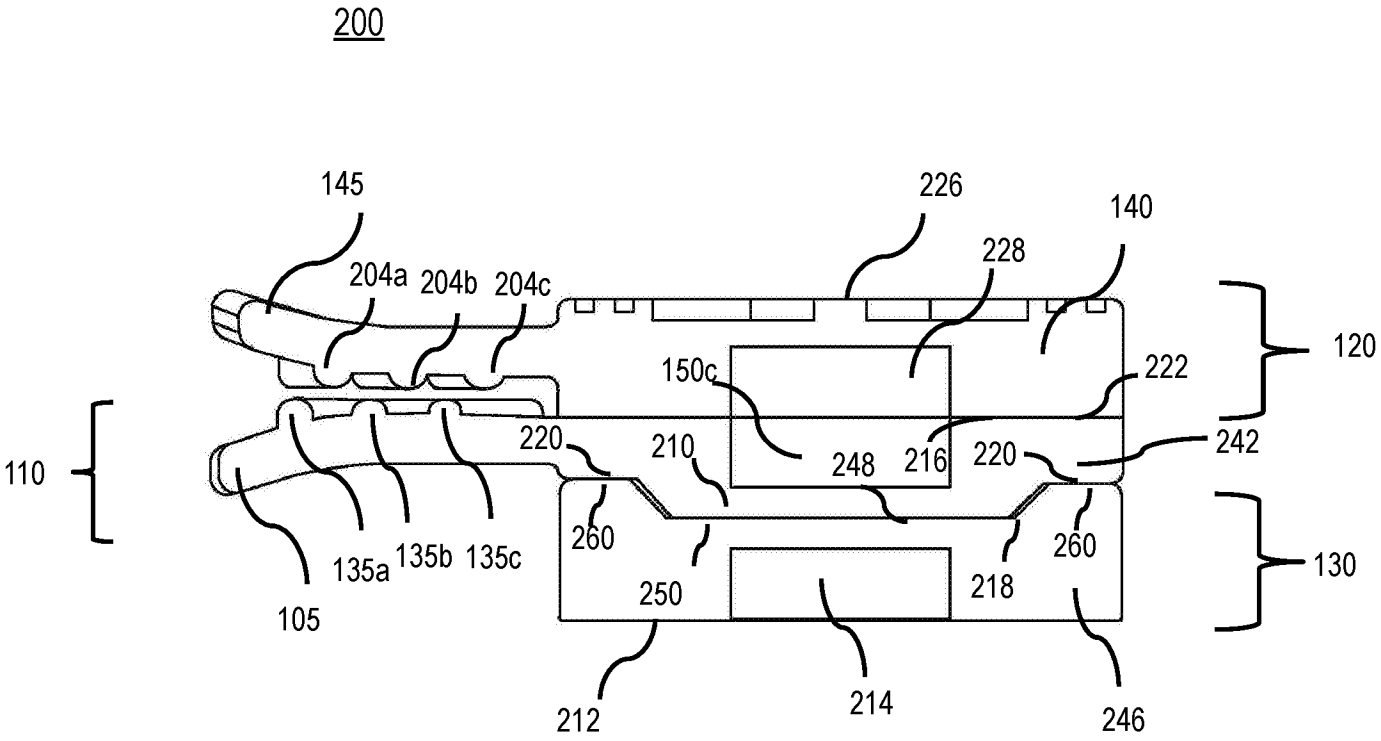
FIG. 2 illustrates one preferred embodiment of a sealing closure.

FIG. 2 illustrates a sealing closure 200 according to an embodiment of the invention. The sealing closure 200 comprises a first flexible strip 110, a second flexible strip 120, and a third flexible strip 130. The first flexible strip 110 is affixed to a first grip extension 105 where the first grip extension has raised axial guides 135*a-c*. The second flexible strip 120 is affixed to a second grip extension 145 with raised axial guides 204*a-c*. The first set of raised axial guides 135*a-c* are positioned to grip the second set of raised axial guides 204*a-cc*.

The first flexible strip 110 has a first side 216 and a second side 248. The first flexible strip 110 comprises a plurality of recessed areas each having a magnet. One of the magnets is shown as 150*c*. The second flexible strip 120 has a first side 226 and a second side 222. The second flexible strip 120 comprises a plurality of recessed areas each having a magnet one of the magnets is shown as 228. The first magnet 150*c* interacts with the second magnet 228 to create a seal between the first side 216 of the first flexible strip 110 and the second side 222 of the second flexible strip 120.

The first flexible strip 110 has a non-uniform thickness defined by its first side 216 and second side 248. The second flexible strip 120 has a uniform thickness defined by its first side 226 and second side 222. The thickness across the second flexible strip 120 is uniform with no recessed edges or raised portions on the first side 226 or second side 222 of the second flexible strip 200. The thickness across the first flexible strip 200 is non-uniform as illustrated by the second side 248 having a raised portion 210 with recessed edges 220. In another embodiment the second flexible strip 120 can have a non-uniform thickness define by its first side and second side.

The third flexible strip 130 has a first side 218 and a second side 212. The third flexible strip 130 comprises a plurality of recessed areas each having a magnet. One of the magnets is shown as 214. The third flexible strip 130 has a non-uniform thickness defined by its first side 218 and second side 212. The thickness across the third flexible strip 130 is non-uniform illustrated by the first side 218 having a recessed portion 250 with raised edges 260.

The magnets 150*c* interacts with the third magnets 214 to create a seal between the second side 248 of the first flexible strip 110 and the first side 218 of the third flexible strip 130. The raised portion 210 of the first flexible strip 110 fits into the recessed portion 250 of the third flexible strip 130 to further increase the seal. Additionally, the third magnet 214 interacts with the second magnet 228 to increase the seal between the first side 216 of the first flexible strip 110 and the second side of the second flexible strip 120.

In certain embodiments, the plurality of cavities also refers to recessed areas. The plurality of cavities of the first strip, the second strip, and the third strip may be niches, recesses, pits, openings, holes, full openings, or apertures. Further, the plurality of cavities of the strips are equally spaced between each other at a distance of between about 2 mm and about 8 mm, such that each magnetic element within each cavity of the plurality of cavities has a diameter of between about 4 mm and about 10 mm, and a thickness of between about 1 mm and about 3 mm.

Figure 3:
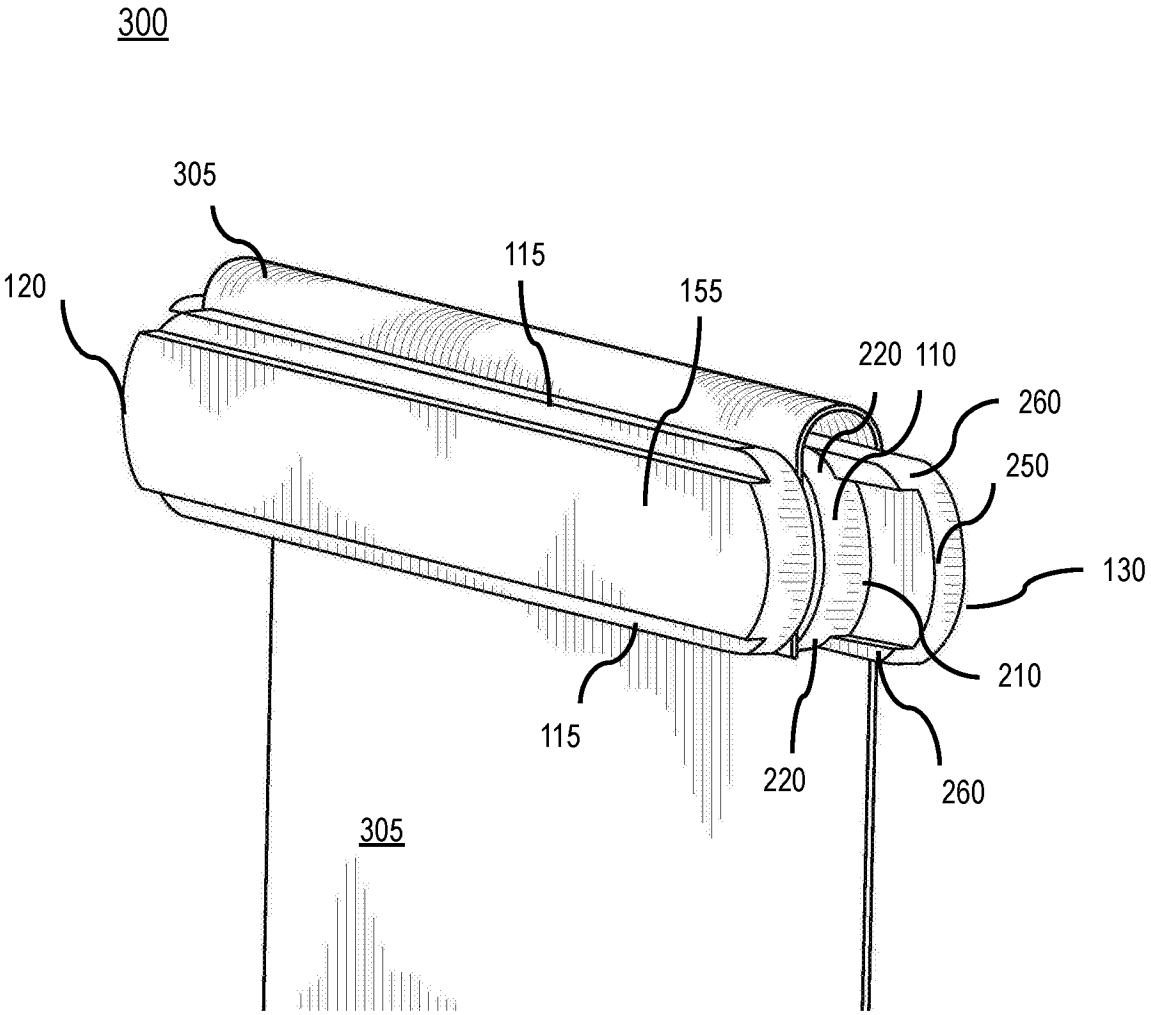
FIG. 3 illustrates one perspective view of one specific embodiment of a sealing closure.

FIG. 3 illustrates one perspective view of one specific embodiment of the invented sealable closure. The sealing closure 300 comprises a membrane 305, first flexible strip 110, second flexible strip 120, and third flexible strip 130. Wherein the first flexible strip 110, second flexible strip 120, and third flexible strip 130 all have non-uniform thickness. The membrane 305 is used as an enclosure that, when sealed, provides a barrier to protect the contents inside the membrane 305. The membrane can have a predetermined thickness. For example, the predetermined thickness can be between about 0.05 mm and about 0.6 mm. In an example, the predetermined thickness can be between about 0.2 mm and 0.4 mm. The membrane 305 can protect against a number of things including water, soda, and similar such intrusive elements. The membrane 305, when unsealed, is open-ended at the top to allow an individual to place items into the membrane 305. The membrane 305 can vary in size, color and shape. The membrane has a first side and a second side. When closed, the first flexible strip 110, second flexible strip 120, and third flexible strip 130 seal the membrane 305 protecting the contents inside the membrane 305.

The first side of the membrane 305 is affixed to the first side of the first flexible strip 110. The second side of the membrane 305 is affixed to the second side of the second flexible strip 120. When the first set of magnets in the first flexible strip 110 interact with the second set of magnets in the second flexible strip 120 the first side 305 of the membrane and the second side of the membrane 305 are brought together creating a first seal preventing unwanted contents, such as water, from entering the top side of the membrane 305. In certain cases, the membranes are walls of a sealable device. Examples of sealable devices include but are not limited to: a pouch, a bag, a sack, a pocket, a device useful for sterile purposes, a door with a frame, a tent, a greenhouse, or a waterproof pocket.

The first set of magnets of the first flexible strip 110 interacts with the third set of magnets of the third flexible strip 130 to create a second seal. The raised portion 210 of the first flexible strip 110 fits into the recessed portion 250 of the third flexible strip 130 to further increase the seal. The third set of magnets of the third flexible strip 130 also interacts with the second set of magnets of the second flexible strip 120 strengthening the first seal between the first and second side of the membrane 305, which is between the first flexible strip 110 and the second flexible strip 120. The first side of the membrane 305 is affixed to the second side of the third flexible seal 130. In another embodiment the second side of the membrane is affixed to the first side of the third flexible seal 130. In such an embodiment, the first set of magnets in the first flexible strip 110 interacts with the third set of magnets in the third flexible strip 130 causing the first and second side of the membrane 305 to be brought together creating an additional seal, preventing unwanted contents from entering the top side of the membrane 305. Notably, the first seal is stable to mechanical deformations selected from the group consisting of: bending, rotation, twisting, and/or tilting. Further, the first seal is flexible and water impermeable.

In another embodiment the first side of the membrane 305 is affixed to the second side of the third flexible seal 130. In such an embodiment, the second set of magnets in the second flexible strip 120 interacts with the third set of magnets in the third flexible strip 130 cause the first and second side of the membrane 305 to be brought together creating an additional seal, preventing unwanted contents from entering the top side of the membrane 305. In such an embodiment, the second set of magnets of the second flexible strip 120 interacts with the third set of magnets of the third flexible strip 130 to create a seal. The raised portion 156 of the second flexible strip 120 fits into the recessed portion (not shown) of the third flexible strip 130 to further increase the seal. The third set of magnets of the third flexible strip 130 interact with the first set of magnets of the first flexible strip 110 strengthening the seal between the first and second side of the membrane, which are between the first flexible strip 110 and the second flexible strip 120.

In specific examples, the strips and the membranes are sealingly connected via mechanical connection means, and wherein said mechanical connection means are selected from the group consisting of: RF welding, ultrasonic welding, heat welding, sewing, via a seal tape, or gluing.

Figure 4:
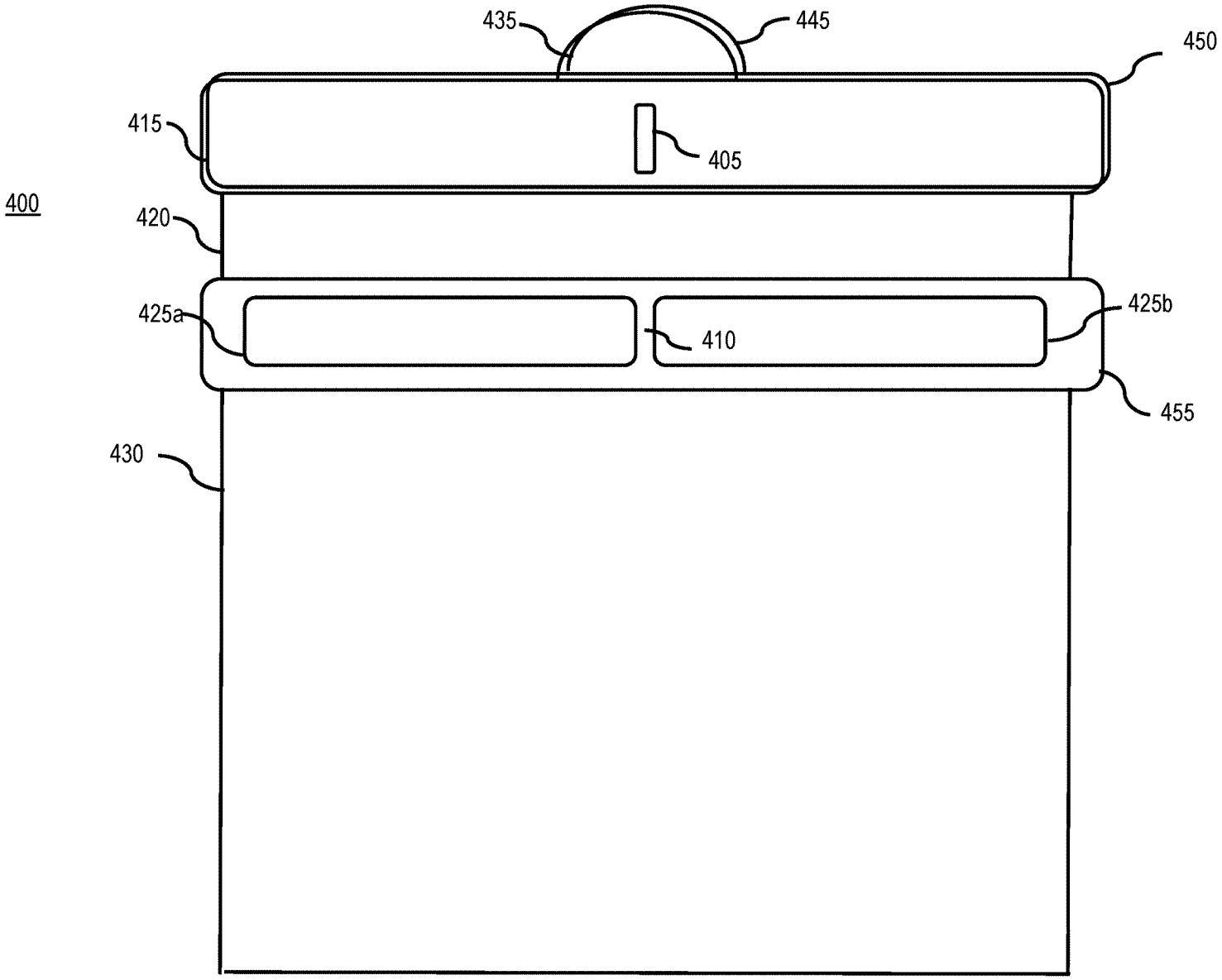
FIG. 4 illustrates one perspective view of another specific embodiment of a sealing closure.

FIG. 4 illustrates one perspective view of another specific embodiment of the invented sealable closure. The sealing closure comprises a membrane 420, first flexible strip 415, second flexible strip 450, and third flexible strip 455, wherein first flexible strip 415, and third flexible strip 455 are of non-uniform thickness.

The first side of the membrane 420 is affixed to the first side of the first flexible strip 415. The second side of the membrane 420 is affixed to the second side of the second flexible strip 450. When the first set of magnets in the first flexible strip 415 interact with the second set of magnets in the second flexible strip 450 the first side of the membrane 420 and the second side of the membrane 420 are brought together creating a seal preventing unwanted contents from entering the top side of the membrane 420. Each first and second membrane has a predetermined static friction coefficient which limits movement of the membranes with respect to each other. For example, the predetermined static friction coefficient of said membranes can be between 0.01 and 0.99. In another example, the predetermined static friction coefficient of said membranes can be between 0.01 and 0.6.

The first set of magnets of the first flexible strip 415 interacts with the third set of magnets of the third flexible strip 455 to create a second seal. The raised portion 405 of the first flexible strip 415 fits into the recessed portion 410 of the third flexible strip 455 to strengthen the seal. Without the raised portion 405 fitting into the recessed portion 410 the first flexible strip 415 and second flexible strip 455 could be misaligned. Misalignment weakens the seal for a number of reasons. For examples, if the first set of magnets of the first flexible strip 415 are misaligned with the third set of magnets of the third flexible strip 455 the full strength of the magnetic seal will not be utilized. The attractive force between two magnetics increases as the distance between them decreases. A misalignment will result in a greater distance between magnets resulting in a decrease in seal strength.

Additionally, the raised portions 425*a*-425*b* of the third flexible strip 455 help guide the raised portion 405 of the first flexible strip 415 to a self-aligned, sealing position. Instead of the user having to take time to align the first flexible strip 415 with the third flexible strip 455, the raised portions 425*a*-425*b* facilitate automatic alignment of the strips to create an effective seal between the first flexible strip 455 and third flexible strip 455. Once the seal is established the raised portions 425*a*-425*b* help strength the seal by further securing the first flexible strip 415 to the third flexible strip 455. For example, in transit the sealable closure 400 can be bumped or dropped. Such force could cause the first flexible strip 415 to misalign from the third flexible strip 455, or even break the seal. The raised portion 405 of the first flexible strip 415 interacting with the recessed portion 410 of the third flexible strip 455 prevents unsealing.

In addition to the third set of magnets of the third flexible strip 455 interacting with the first set of magnets of the first flexible strip 415, the third set of magnets of the third flexible strip 455 also interacts with the second set of magnets of the second flexible strip 450. The interaction between the third set of magnets of the third flexible strip 455 and the second set of magnets of the second flexible seal 450 strengthens the seal between the first set of magnets of the first flexible strip 415 and the second set of magnets of the second flexible strip 450.

In specific embodiments, first strip and said second strip have a width of between 10 mm and 20 mm, and wherein said uniform predetermined thickness of said first strip and said second strip is between 1 mm and 3 mm.

The sealing closure can be manufactured by extrusion, coextrusion, or molding. The membranes and the strips can comprise polymeric materials including but not limited to: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ketone)s (PEEK, PES/PEEK), polyethylene (PE), polyethylene glycol) (PEG), poly (ethylene terephthalate) (PET), polypropylene (PP), polytetrafluoroethylene (PTFE), styrene-acrylonitrile resin (SAN), poly (trimethylene terephthalate) (PTT), polyurethane (PU), polyvinyl butyral (PVB), polyvinylchloride (PVC), polyvinylidenedifluoride (PVDF), or polyvinyl pyrrolidone (PVP).

The invention has been described herein using specific embodiments for illustrative purposes only. It will be readily apparent to one of ordinary skill in the art, however, that principles of the invention can be embodied in other ways. Therefore, the invention should not be regarded as being limited in scope to the specific embodiments disclosed herein, but instead as being fully commensurate in scope with the following drawings and claims.

We claim:

1. A magnetic sealing closure, comprising:

a first flexible strip, having a first side and a second side, with a plurality of cavities having a plurality of magnetic elements therein, the second side of the first flexible strip having a raised portion;

a second flexible strip, having a first side and a second side, with a plurality of cavities having a plurality of magnetic elements therein;

a third flexible strip, having first side and a second side, with a plurality of cavities having a plurality of magnetic elements therein, the second side of the third flexible strip having a recessed portion corresponding to the raised portion of the second side of the first flexible strip;

a first membrane coupled to said first side of said first strip, such that said plurality of magnetic elements of said first strip are flush mounted and embedded within said plurality of cavities between said first strip and said first membrane, said first membrane further coupled to said first side of said third strip, such that said plurality of magnetic elements of said third strip are flush mounted and embedded within said plurality of cavities between said third strip and said first membrane; and a second membrane coupled to said first side of said second strip, such that said plurality of magnetic elements of said second strip are flush mounted and embedded within said plurality of cavities between said second strip and said second membrane;

wherein said first and said second strips provide a first seal when said first and said second strips are brought together from said first sides of said first and said second strips and magnetic elements of said first and said second strips magnetically attract each other, wherein said first and said third strips provide a second seal when said first, said second, and said third strips are subsequently brought together from said second sides of said first and said third strips and magnetic elements of said first and said third strips magnetically attract each other.

2. The magnetic sealing closure of claim 1, wherein each of said membranes have a predetermined static friction coefficient which substantially prevents movement of said membranes with respect to each other.

3. The magnetic sealing closure of claim 1, wherein said membranes are walls of a sealable device.

4. The magnetic sealing closure of claim 1, wherein said magnetic elements of said strips comprise a material selected from the group consisting of: Neodymium, Neodymium Iron Boron (NdFeB), Samarium-Cobalt, or Electromagnet.

5. The magnetic sealing closure of claim 1, wherein said first seal is stable to mechanical deformations selected from the group consisting of: bending, rotation, twisting, and/or tilting.

6. The magnetic sealing closure of claim 1, wherein said first seal is flexible and water impermeable.

7. The magnetic sealing closure of claim 1, wherein said strips and said membranes are sealingly connected via mechanical connection means, and wherein said mechanical connection means are selected from the group consisting of: RF welding, ultrasonic welding, heat welding, sewing, via a seal tape, or gluing.

8. The magnetic sealing closure of claim 1, wherein said sealing closure is incorporated in a sealable device which is selected from the group consisting of: a pouch, a bag, a sack, a pocket, a device useful for sterile purposes, a door with a frame, a tent, a greenhouse, or a waterproof pocket.

9. The magnetic sealing closure of claim 1, wherein the second flexible strip has a non-uniform thickness.

10. The magnetic sealing closure of claim 1, wherein said plurality of cavities of said first strip, said second strip, and said third strip are selected from the group consisting of: niches, recesses, pits, openings, holes, full openings, or apertures.

11. The magnetic sealing closure of claim 1, wherein said sealing closure is manufactured according to a method selected from the group consisting of: extrusion, coextrusion, or molding.

12. The magnetic sealing closure of claim 1, wherein said membranes each have a predetermined thickness of between 0.05 mm and 0.6 mm.

13. The magnetic sealing closure of claim 1, wherein said membranes each have a predetermined thickness of between 0.2 mm and 0.4 mm.

14. The magnetic sealing closure of claim 1, wherein said plurality of cavities of said strips are equally spaced between each other at a distance of between 2 mm and 8 mm, such that each magnetic element within each cavity of said plurality of cavities has a diameter of between 4 mm and 10 mm, and a thickness of between 1 mm and 3 mm.

15. The magnetic sealing closure of claim 1, wherein said first strip and said second strip have a width of between 10 mm and 20 mm, and wherein said uniform predetermined thickness of said first strip and said second strip is between 1 mm and 3 mm.

16. The magnetic sealing closure of claim 1, wherein said membranes and said strips comprise polymeric materials selected from the group consisting of: elastomer, rubber, TPR, TPE, TPU, HPU, Neoprane, Polyacrylates, Polyamides, Polyesters, Polycarbonates, Polyimides, Polystyrenes, acrylonitrile butadiene styrene (ABS), polyacrylonitrile (PAN) or Acrylic, polybutadiene, poly (butylene terephthalate) (PBT), poly (ether sulfone) (PES, PES/PEES), poly(ether ketone)s (PEEK, PES/PEEK), polyethylene (PE), polyethylene glycol) (PEG), poly (ethylene terephthalate) (PET), polypropylene (PP), polytetrafluoroethylene (PTFE), styrene-acrylonitrile resin (SAN), poly(trimethylene terephthalate) (PTT), polyurethane (PU), polyvinyl butyral (PVB), polyvinylchloride (PVC), polyvinylidenedifluoride (PVDF), or polyvinyl pyrrolidone (PVP).

17. The magnetic sealing closure of claim 2, wherein said predetermined static friction coefficient of said membranes is between 0.01 and 0.99.

18. The magnetic sealing closure of claim 2, wherein said predetermined static friction coefficient of said membranes is between 0.1 and 0.6.

19. A magnetic sealing closure, comprising:

a first flexible strip, having a first side and a second side, with a plurality of cavities having a plurality of magnetic elements therein, the second side of the first flexible strip having a recessed portion;

a second flexible strip, having a first side and a second side, with a plurality of cavities having a plurality of magnetic elements therein;

a third flexible strip, having a first side and a second side, with a plurality of cavities having a plurality of magnetic elements therein, the second side of the third flexible strip having a raised portion corresponding to the recessed portion of the second side of the first flexible strip;

a first membrane coupled to said first side of said first strip, such that said plurality of magnetic elements of said first strip are flush mounted and embedded within said plurality of cavities between said first strip and said first membrane, said first membrane further coupled to said first side of said third strip, such that said plurality of magnetic elements of said third strip are flush mounted and embedded within said plurality of cavities between said third strip and said first membrane; and a second membrane coupled to said first side of said second strip, such that said plurality of magnetic elements of said second strip are flush mounted and embedded within said plurality of cavities between said second strip and said second membrane;

wherein said first and said second strips provide a first seal when said first and said second strips are brought together from said first sides of said first and said second strips and magnetic elements of said first and said second strips magnetically attract each other, wherein said first and said third strips provide a second seal when said first, said second, and said third strips are subsequently brought together from said second sides of said first and said third strips and magnetic elements of said first and said third strips magnetically attract each other.

20. A magnetic sealing closure, comprising:

a first flexible strip, having a non-uniform thickness with one or more recesses or protrusions, a first side and a second side, with a plurality of cavities having a plurality of magnetic elements therein;

a second flexible strip, having a first side and a second side, with a plurality of cavities having a plurality of magnetic elements therein;

a third flexible strip, having a non-uniform thickness with one or more recesses or protrusions, a first side and a second side, with a plurality of cavities having a plurality of magnetic elements therein, the one or more recesses or protrusions of the third flexible strip mating to the one or more recesses or protrusions of the first flexible strip;

a first membrane coupled to said first side of said first strip, such that said plurality of magnetic elements of said first strip are flush mounted and embedded within said plurality of cavities between said first strip and said first membrane, said first membrane further coupled to said first side of said third strip, such that said plurality of magnetic elements of said third strip are flush mounted and embedded within said plurality of cavities between said third strip and said first membrane; and a second membrane coupled to said first side of said second strip, such that said plurality of magnetic elements of said second strip are flush mounted and embedded within said plurality of cavities between said second strip and said second membrane;

wherein said first and said second strips provide a first seal when said first and said second strips are brought together from said first sides of said first and said second strips and magnetic elements of said first and said second strips magnetically attract each other, wherein said first and said third strips provide a second seal when said first, said second, and said third strips are subsequently brought together from said second sides of said first and said third strips and magnetic elements of said first and said third strips magnetically attract each other.

* * * * *